US011959355B2

(12) United States Patent
Barrett et al.

(10) Patent No.: US 11,959,355 B2
(45) Date of Patent: Apr. 16, 2024

(54) FRAC PLUG SLIPS WITH UNIFORM BREAKING MECHANISM AND METHOD

(71) Applicant: GEODYNAMICS, INC., Millsap, TX (US)

(72) Inventors: Casey Barrett, GrandView, TX (US); Jeremy Eli Castaneda, Weatherford, TX (US); Raymond Christopher Shaffer, Burleson, TX (US)

(73) Assignee: GEODYNAMICS, INC., Millsap, TX (US)

( * ) Notice: Subject to any disclaimer, the term of this patent is extended or adjusted under 35 U.S.C. 154(b) by 283 days.

(21) Appl. No.: 17/341,571

(22) Filed: Jun. 8, 2021

(65) Prior Publication Data

US 2022/0034191 A1 Feb. 3, 2022

Related U.S. Application Data

(60) Provisional application No. 63/057,662, filed on Jul. 28, 2020.

(51) Int. Cl.

| | |
|---|---|
| ***E21B 33/129*** | (2006.01) |
| ***E21B 33/12*** | (2006.01) |
| *E21B 43/26* | (2006.01) |

(52) U.S. Cl.

CPC ..... *E21B 33/1291* (2013.01); *E21B 33/1208* (2013.01); *E21B 43/26* (2013.01)

(58) Field of Classification Search

CPC .. E21B 33/1291; E21B 33/1208; E21B 43/26; E21B 19/10; E21B 33/129; E21B 33/1293; E21B 33/1285; E21B 33/34; E21B 23/01; E21B 34/16; E21B 33/124

See application file for complete search history.

(56) References Cited

U.S. PATENT DOCUMENTS

| | | | | |
|---|---|---|---|---|
| 9,157,288 | B2 * | 10/2015 | Martinez | E21B 23/01 |
| 9,759,029 | B2 * | 9/2017 | Davies | E21B 33/134 |
| 9,845,658 | B1 * | 12/2017 | Nish | E21B 33/128 |
| 11,078,739 | B2 * | 8/2021 | Davies | E21B 23/01 |
| 11,168,535 | B2 * | 11/2021 | Saeed | E21B 33/1216 |
| 2017/0101836 | A1 * | 4/2017 | Webster | E21B 33/1293 |
| 2017/0268310 | A1 | 9/2017 | Shkurti et al. | |
| 2019/0169951 | A1 * | 6/2019 | Frazier | E21B 33/1204 |
| 2021/0254428 | A1 * | 8/2021 | Roessler | E21B 23/0413 |
| 2021/0372212 | A1 * | 12/2021 | Shaffer | E21B 23/06 |

* cited by examiner

*Primary Examiner* — Yong-Suk (Philip) Ro

(74) *Attorney, Agent, or Firm* — Morgan, Lewis & Bockius LLP

(57) ABSTRACT

A downhole tool for sealing a well includes a push ring, a first slip ring located adjacent to the push ring, a first wedge located adjacent to the first slip ring and configured to radially push the first slip ring and separate the first slip ring into individual parts, and a sealing element located adjacent to the first wedge and configured to seal the well. An upstream end of the first slip ring and a downstream end of the push ring form a wavy interface when in contact. The wavy interface locks the first slip ring relative to the push ring to prevent a rotation of the first slip ring relative to the push ring.

19 Claims, 12 Drawing Sheets

FRAC PLUG SLIPS WITH UNIFORM BREAKING MECHANISM AND METHOD

BACKGROUND

TECHNICAL FIELD

Embodiments of the subject matter disclosed herein generally relate to downhole tools related to perforating and/or fracturing operations, and more specifically, to a plug that uses a uniform breaking mechanism for uniformly breaking the plug slips when the plug is set.

DISCUSSION OF THE BACKGROUND

In the oil and gas field, once a well 100 is drilled to a desired depth H relative to the surface 110, as illustrated in FIG. 1, and the casing 102 protecting the wellbore 104 has been installed and cemented in place, the wellbore 104 needs to be fluidly connected to the subterranean formation 106 that holds the oil and/or gas. This process of connecting the wellbore to the subterranean formation may include a step of plugging the well with a plug 112, a step of perforating the casing 102 with a perforating gun 114 such that various channels 116 are formed to fluidly connect the subterranean formations 106 to the inside of the casing 102, a step of removing the perforating gun 114 from the perforated stage, and a step of fracturing the various channels 116 in that stage.

Some of these steps require to lower in the well 100 a wireline 118, which is electrically and mechanically connected to the perforating gun 114, and to activate the perforating gun and/or a setting tool 120 attached to the perforating gun 114. The setting tool 120 is configured to hold the plug 112 prior to plugging the well and to set it before fracturing the corresponding stage. FIG. 1 shows the setting tool 120 disconnected from the plug 112, indicating that the plug has been set in the casing to seal its bore and the setting tool 120 has been disconnected from the plug 112.

FIG. 1 shows the wireline 118, which includes at least one electrical connector, being connected to a control interface 122, located on the ground 110, above the well 100. An operator of the control interface may send electrical signals to the perforating gun and/or setting tool for setting the plug 112 and disconnecting the setting tool from the plug. A fluid 124, (e.g., water, water and sand, fracturing fluid, etc.) may be pumped by a pumping system 126, down the well, for moving the perforating gun 114 and the setting tool to a desired location, e.g., where the plug 112 needs to be deployed, and also for fracturing purposes.

The above operations may be repeated multiple times for perforating and/or fracturing the casing at multiple locations, corresponding to different stages of the well. Note that in this case, multiple plugs 112 and 112' may be used for isolating the respective stages from each other during the perforating phase and/or fracturing phase. These completion operations that involve the plug-and-perf multistage fracturing method, use plural plugs to isolate each phase. Each plug is pumped downhole with water and set in place to isolate the stages. The plugs ensure that the fracturing fluids are directed into a specific stage.

A frac plug 200 that is used for the completion of the wells is shown in FIG. 2 and has a mandrel 202 on which the following elements are added: a top push ring 203, upper slip ring 204, upper wedge 206, sealing element 208, lower wedge 210, lower slip ring 212, a bottom push ring 216 and a mule shoe 218. When the setting tool 120 (see FIG. 1) presses on the push ring 203, the intermediate components press against the mule shoe 218, causing the sealing element 208 to expand radially and seal the casing. The upper and lower wedges 206 and 210 press on their corresponding slip rings 204 and 212, separating them into plural parts and at the same time forcing the separated parts of the slip rings to press radially against the casing. In this way, the slip rings secure the plug in place and the sealing element seals the well. If the mandrel has a bore (not shown), internal fluid of the well may pass through the plug. In one application, a ball 220 may be released inside the well to seal the internal bore of the mandrel. In another application, the mandrel may have no bore, in which case the plug is a bridge plug that fully seals one region from the other inside the well.

The slip rings 204 and 212 discussed above may be manufactured as a continuous ring, with slots which should help the rings to break up into multiple pieces when the plug is set. It is expected that each slip ring 204 and 212 would ride up on the adjacent wedge 206 and 210, respectively, as the top push ring 203 is compressed toward the mule shoe 218 during the setting operation. As the slip rings ride up the corresponding wedges, they would ideally break apart from each other into individual parts 204A, which would then be evenly spaced around the casing 230, as illustrated in FIG. 3. FIG. 3 also shows the expected uniform spaces 232 between the individual parts 204A, the wedge 206 pressing against the parts 204A, the parts 204A pressing against the casing 230, and the mandrel 202 and the bore 201 formed inside the mandrel 202. This configuration grippingly engages the casing 230 and holds the plug 200 in place in the set position.

A continuous slip ring as illustrated in FIG. 2 is known as "one-piece slip." A one-piece slip is difficult to break apart, and therefore robust during the operation of running the plug into the hole. This robustness is an advantage, as it helps to prevent a failure known as plug preset. A plug preset happens when a jar or obstacle in the well interferes with the advancement of the plug in the bore of the well. The obstacle causes the slip ring or subset of slips to break open and grab the casing before the plug arrives at its intended depth. Once a plug is partially preset, it typically must be fully set to disengage the setting tool, and then milled out with an expensive and time consuming coiled tubing operation. The continuous ring is also fairly easy to handle and install during manufacture, as the rings are easily tracked, stored and stacked. The continuous ring can be pressed in a direct mold, and then machined with holes for the ceramic buttons and preferential slots to encourage even breakage. This process does require a milling operation.

The one-piece slip has the disadvantage that, initially, does not break at every weak section. It often may break into two sections during the initial set, before being finally broken at each weak point during full set. This partial break often leaves large gaps 232B between some adjacent slips elements 204A and smaller gaps 232A between others, as illustrated in FIG. 4 (FIG. 4 omits, for simplicity, to show the wedge and mandrel). This uneven set up results in uneven gripping, and sometimes plug failure.

Another slip design uses individual, or segmented slips. Plugs with individual slips typically use a retaining band to hold the slips in place until the setting operation is performed. The slips can be individually molded or likewise machined from a band of wrapped material. They typically must be held by hand or with a jig during assembly, and then the retaining band installed. Individual slips can be placed more uniformly during the setting operation. This kind of plug may also incorporate individual ramps on the setting wedge to space the slips. The retaining band is a weak way of holding the slips, however, and can break prematurely. Plugs with retaining bands are more likely to be preset inadvertently. In addition, the band can be caught between the slip and the casing, which can prevent the plug from setting correctly, and may reduce the pressure holding capacity of the plug. Similar disadvantages are present for other types of plugs, for example, a big bore plug that has no mandrel and requires no milling. In fact, the problems discussed above are typical to any plug having slip rings.

Thus, there is a need to provide a better plug that distributes the slip ring parts more uniformly along the casing, when the plug is set.

SUMMARY

According to an embodiment, there is a downhole tool for sealing a well, and the downhole tool includes a push ring, a first slip ring located adjacent to the push ring, a first wedge located adjacent to the first slip ring and configured to radially push the first slip ring and separate the first slip ring into individual parts, and a sealing element located adjacent to the first wedge and configured to seal the well. An upstream end of the first slip ring and a downstream end of the push ring form a wavy interface when in contact. The wavy interface locks the first slip ring relative to the push ring to prevent a rotation of the first slip ring relative to the push ring.

According to still another embodiment, there is a downhole tool for sealing a well, and the downhole tool includes a push ring, a first slip ring located adjacent to the push ring, a first wedge located adjacent to the first slip ring and configured to radially push the first slip ring and separate the first slip ring into individual parts, and a sealing element located adjacent to the first wedge and configured to seal the well. The first slip ring has plural initiating trenches formed into a downstream end, and the first wedge has plural corresponding ridges extending radially out from a body of the first wedge.

According to yet another embodiment, there is a method for assembling a downhole tool that has slip rings with uniform breaking parts. The method includes providing a push ring, placing a first slip ring adjacent to the push ring, wherein an upstream end of the first slip ring and a downstream end of the push ring form a wavy interface when in contact, placing a first wedge adjacent to the first slip ring, the first wedge being configured to radially push the first slip ring and separate the first slip ring into individual parts, locking the first slip ring relative to the push ring with the wavy interface to prevent a rotation of the first slip ring, and placing a sealing element next to the first wedge, wherein the sealing element is configured to seal the well.

BRIEF DESCRIPTON OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a solid composite frac plug that has no gaps or voids in the slip rings. However, the embodiments discussed herein are applicable to other plugs, e.g., a big bore plug, or plugs made from other materials, or plugs having plural fingers.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
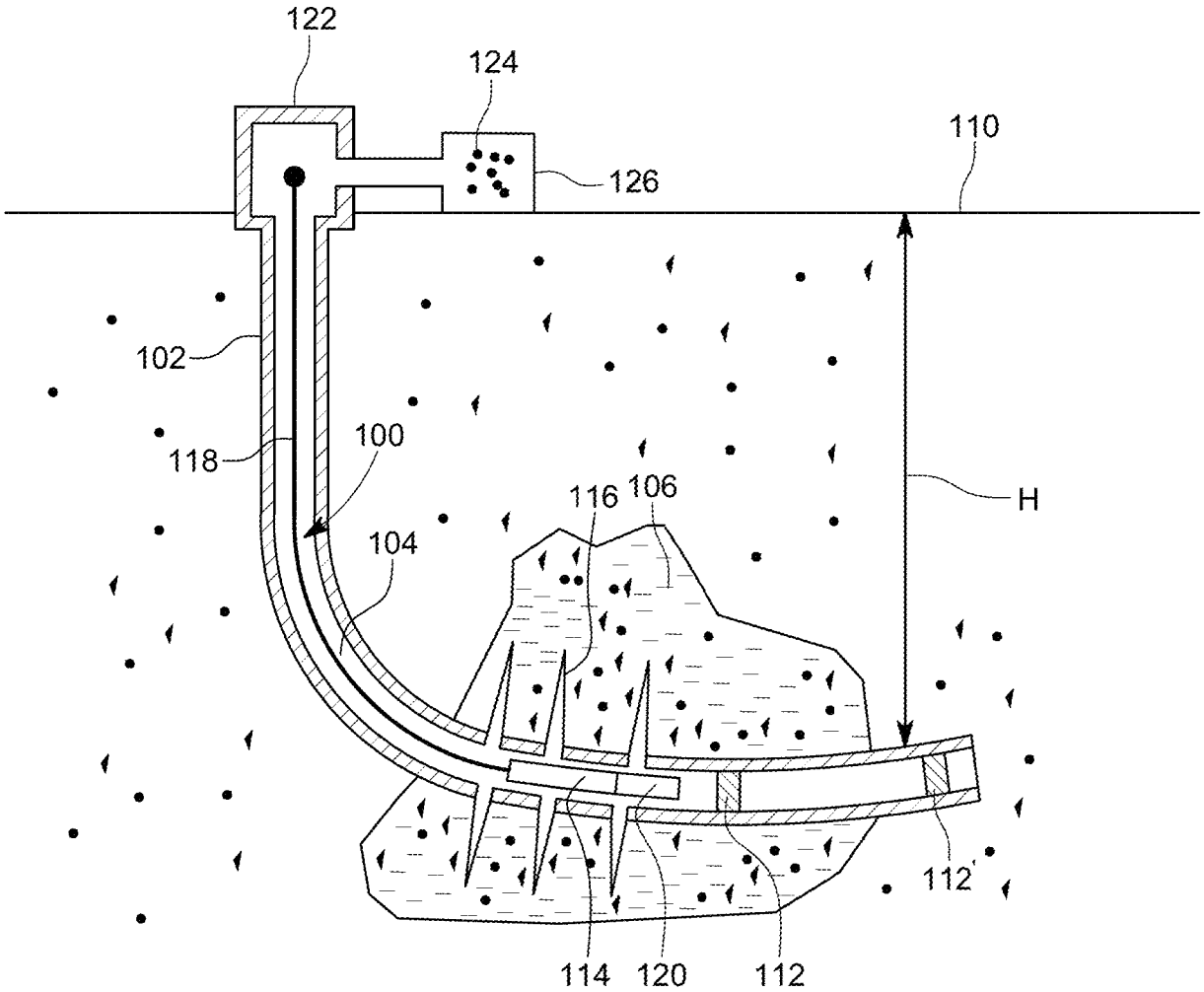
FIG. 1 illustrates a well and associated equipment for well completion operations.
Figure 2:
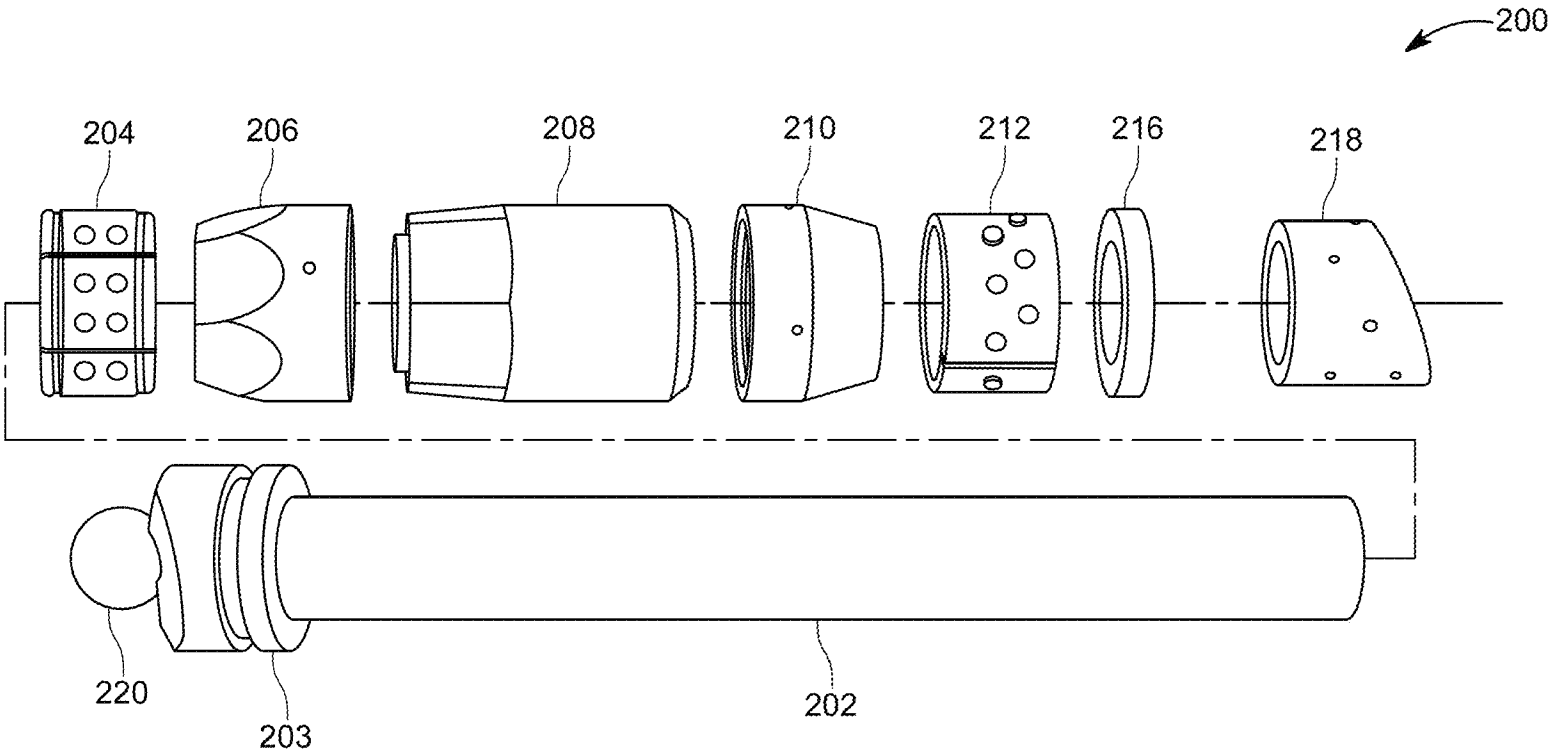
FIG. 2 illustrates a traditional plug for sealing a casing of a well.
Figure 3:
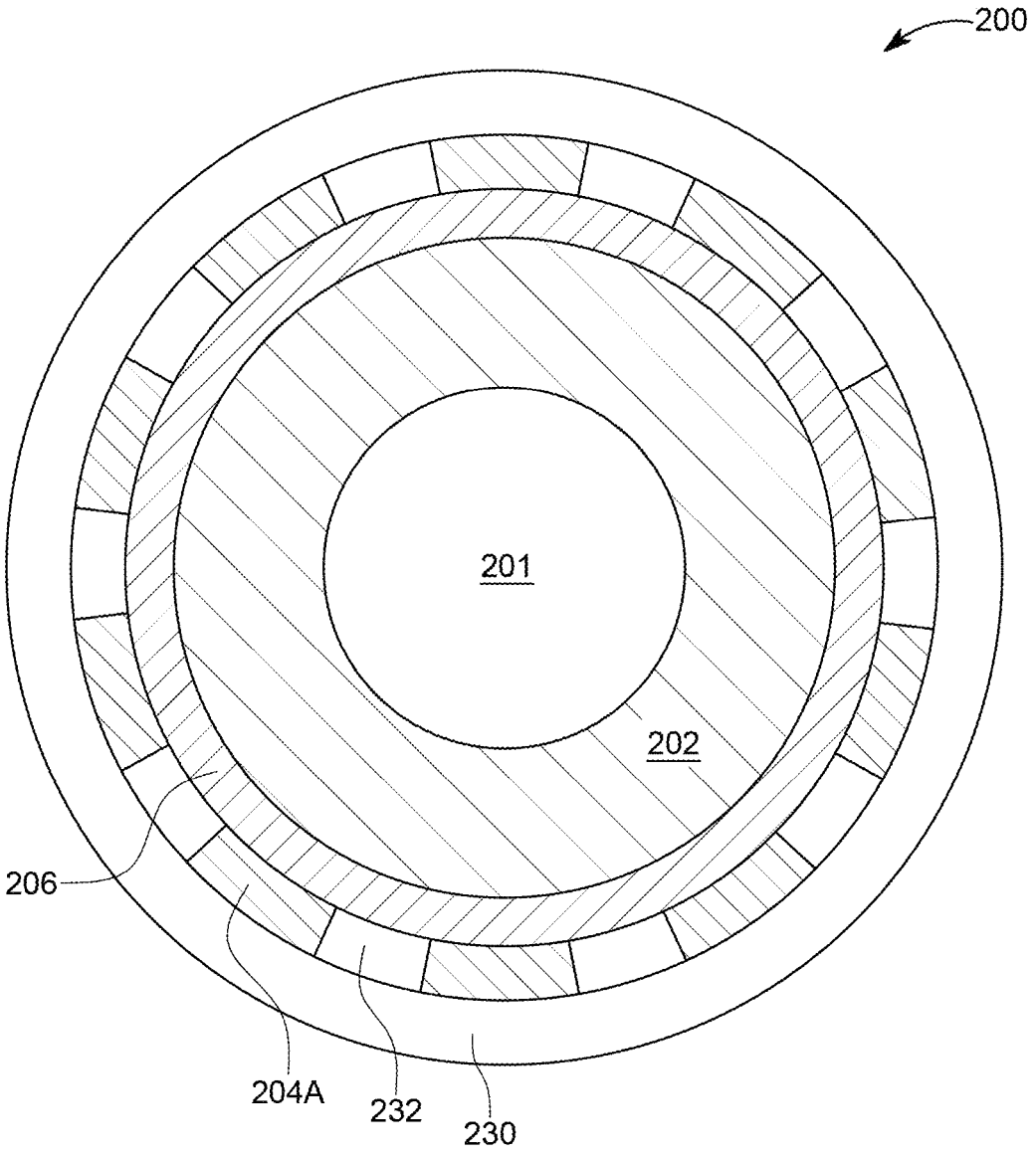
FIG. 3 illustrates an ideal distribution of slip ring parts when the plug is set.
Figure 4:
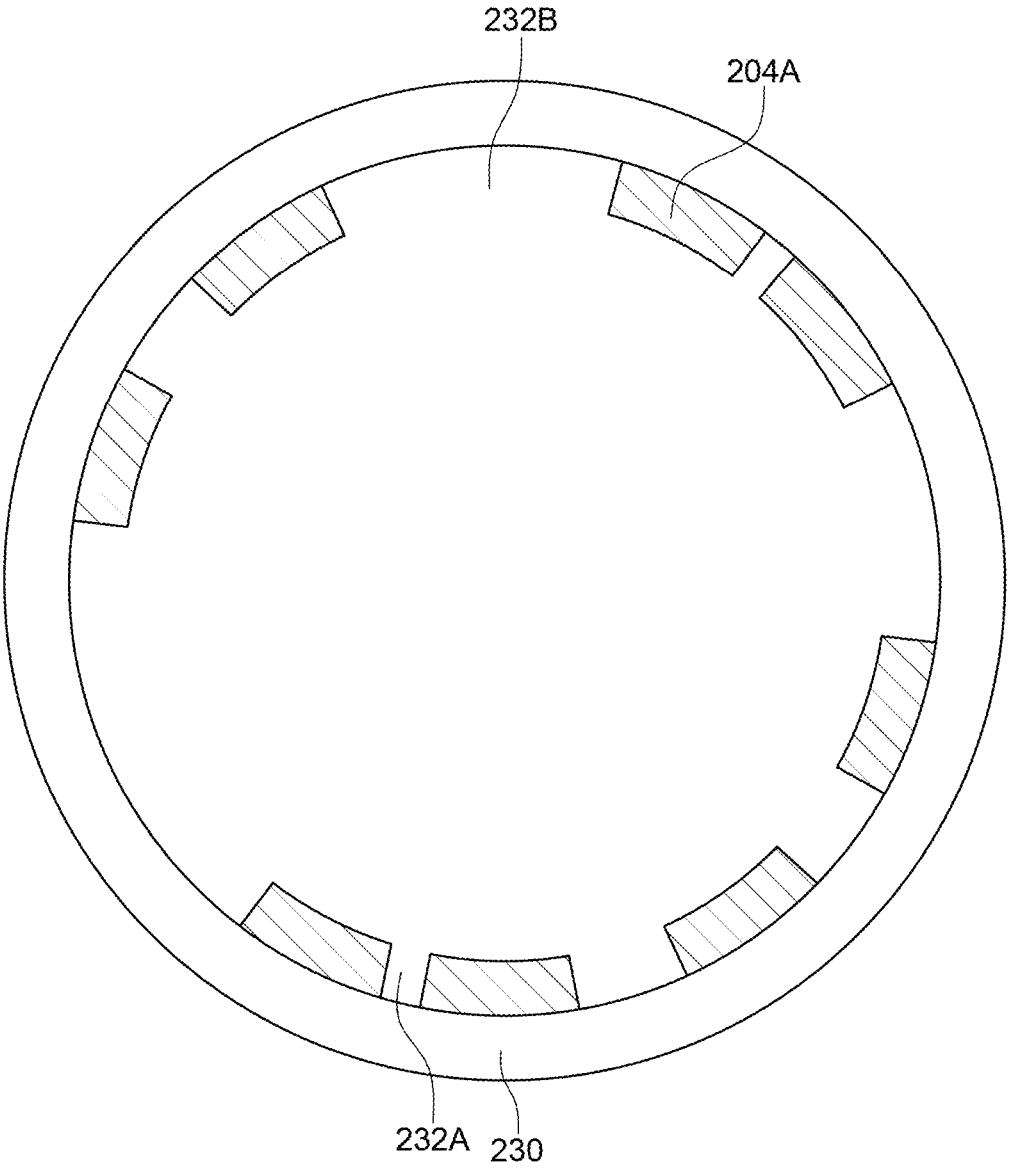
FIG. 4 illustrates an actual distribution of the slip ring parts when the plug is set.
Figure 5:
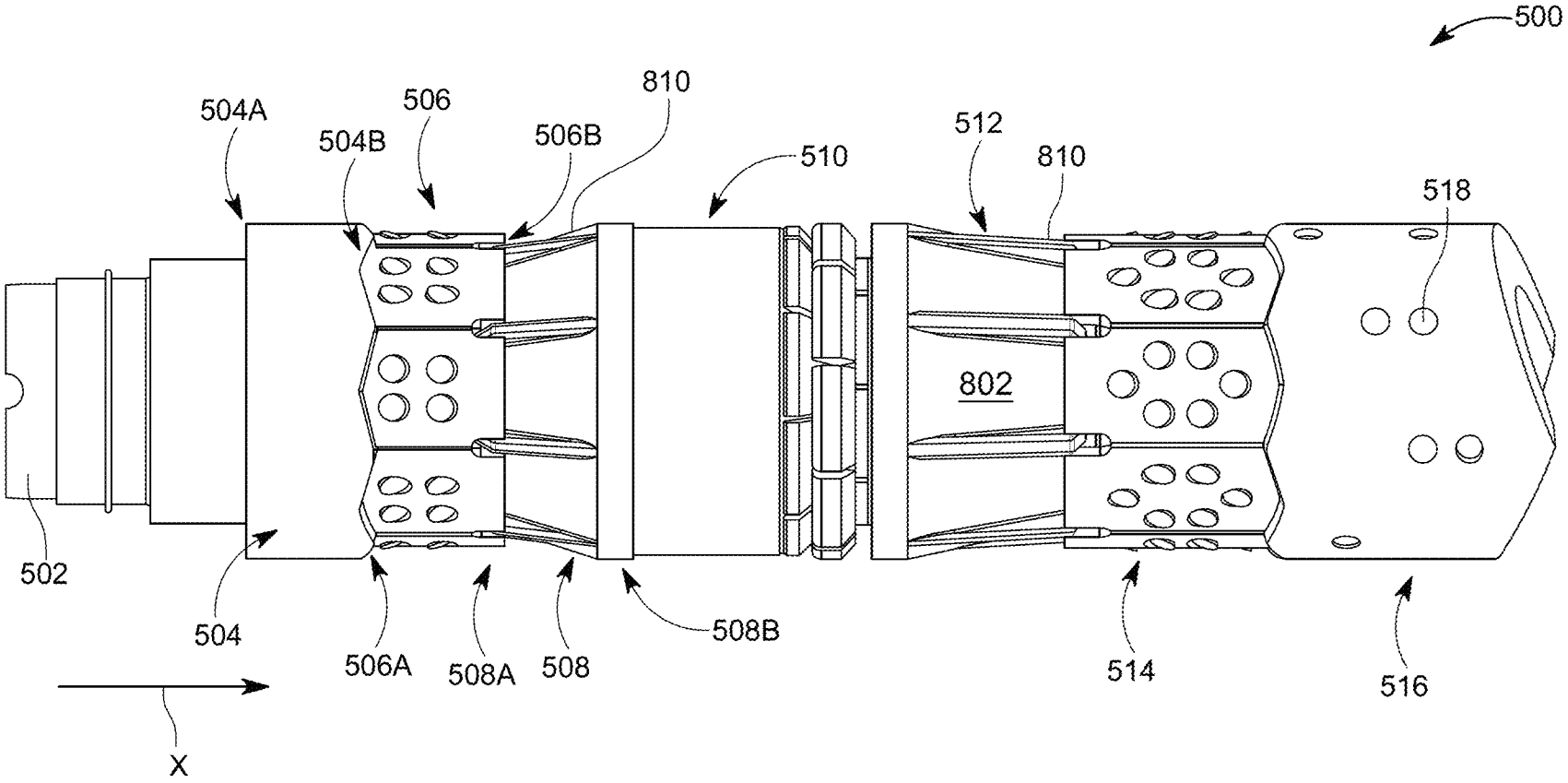
FIG. 5 illustrates a novel plug that has a mechanism for uniformly breaking and fixing in place the various parts of a slip ring.

According to an embodiment illustrated in FIG. 5, a downhole tool 500 (in this embodiment, a frac plug as the downhole tool can include other types of plugs) includes a mandrel 502 having a bore (not seen in this figure), a push ring 504, an upper slip ring 506, an upper wedge 508, a sealing element 510, a lower wedge 512, a lower slip ring 514, and a mule shoe 516. These elements are added to the mandrel 502 in this order in this embodiment. A slip ring is understood in the following to refer to (1) a one piece slip, or (2) partially segmented slips that are mostly not connected to each other, but are retained in a ring shape by certain connection points, or (3) fully segmented slips that are not connected to each other at all, but are retained in a ring shape as they are connected by the alignment feature or (4) any combination of one piece slip and the partially or fully segmented slips. The mule shoe 516 is attached with pins 518 to the mandrel 502. Those skilled in the art would understand that the mule shoe may be added by other ways to the mandrel.

Figure 6:
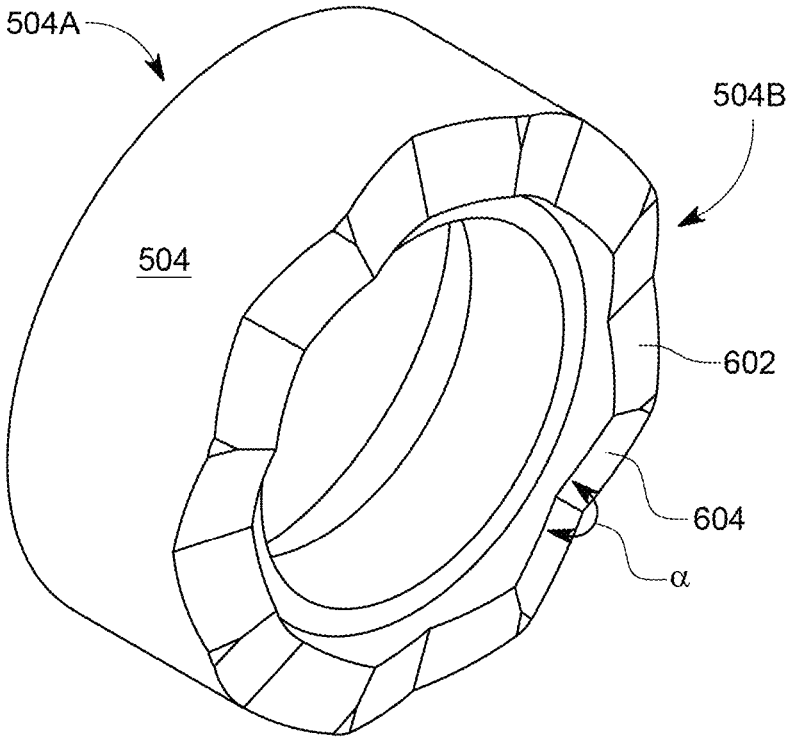
FIG. 6 illustrates a push ring that has a wavy end.

FIG. 5 shows that the push ring 504 has a first end 504A (or upstream end) being shaped to be flat and a second end 504B (or downstream end) being shaped to be non-flat. In this embodiment, the second end 504B of the push ring 504 is wavy, i.e., it has surfaces making various angles with a plane perpendicular to the longitudinal axis X. Note that the longitudinal axis X in the figure also indicates the downstream direction for the plug, when placed in a well. The push ring 504 is shown in more detail in FIG. 6, where plural planar surfaces 602 and 604 make various non-zero angles with the longitudinal axis. In the following, an angle between a plane and an axis is defined as the angle made by the normal to the plane and the axis. While FIG. 6 shows the push ring 504 having the downstream end 504B defined by the planes 602 and 604, those skilled in the art would understand that more than two planes may be used for this end or even a curved surface.

Figure 7:
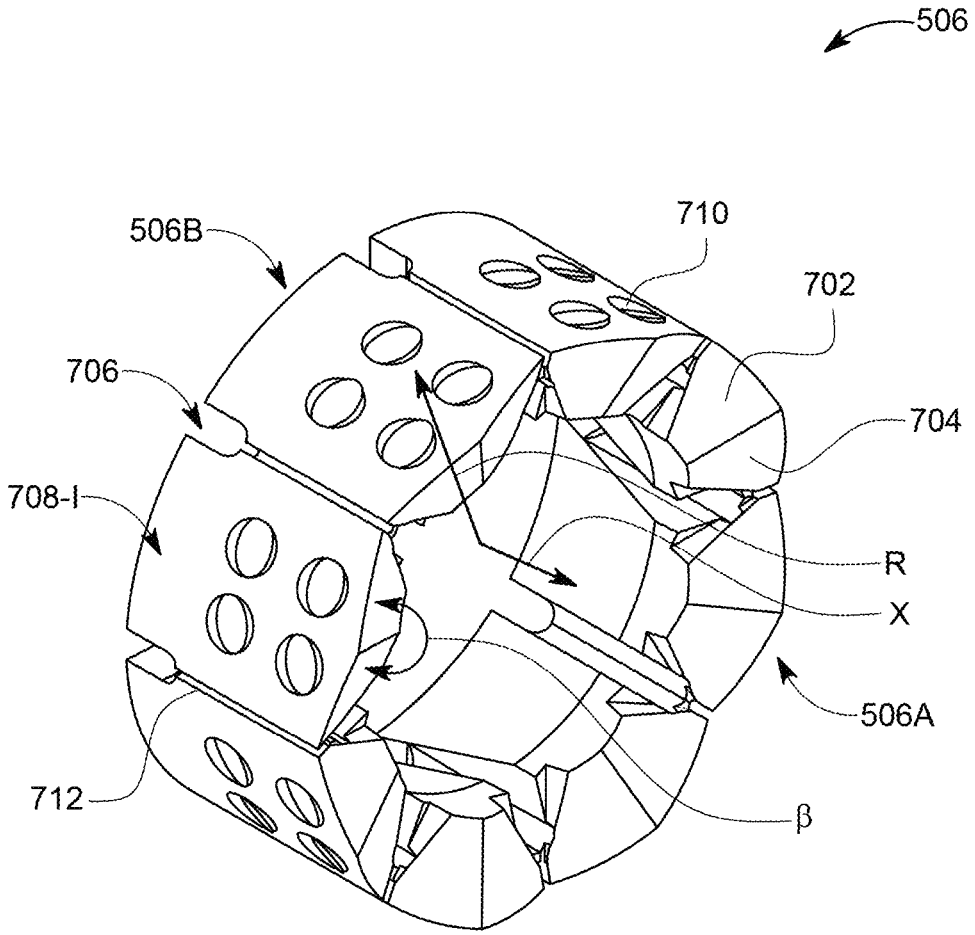
FIG. 7 shows a slip ring that has a corresponding wavy end and initiating trenches on an opposite end.

The goal for the downstream end 504B is to have a profile that is not flat, so that it engages and locks the upstream end 506A of the upper slip ring 506. FIG. 7 shows the upper slip ring 506 having a bore that fits over the mandrel 502, plural slips 710 (for example, ceramic buttons) that are configured to engage the casing of the well, the upstream end 506A being shaped to be non-flat, and the downstream end 506B being flat. The upstream end 506A has the same non-flat profile as the downstream end 504B of the push ring 504, so that the two ends engage and lock each other, to prevent the upper slip ring to rotate around the mandrel 502 while being pushed into the casing. FIG. 7 shows planes 702 and 704, that match the planes 602 and 604 of the push ring 504, and the angle $\beta$ between these planes being complementary to the angle $\alpha$ between the planes 602 and 604, i.e., the angle $\alpha$ plus the angle $\beta$ is 360°. If the downstream end 504B of the push ring 504 is continuously curved, then the upstream end 506A of the upper slip ring 506 has a similar matching shape. FIG. 5 shows that the two ends 504B and 506A match each other perfectly. Those skilled in the art would understand that any non-flat profile may be used for the interface between the push ring 504 and the upper slip ring 506.

FIG. 7 further shows that the downstream end 506B of the upper slip ring 506 has plural initiating cuts or reliefs or trenches 706 formed between plural segments 708-I of the upper slip ring. The segments 708-I are (1) either connected to each other and a corresponding trench 712 separates them, but the trench 712 does not extend through the entire thickness of the upper slip ring, (2) or partially separated from each and connected to each other at one end. No matter how the segments 708-I are connected to each other, the initiating trenches 706 extend through the entire thickness (along the radial direction R) of the upper slip ring.

Figure 8:
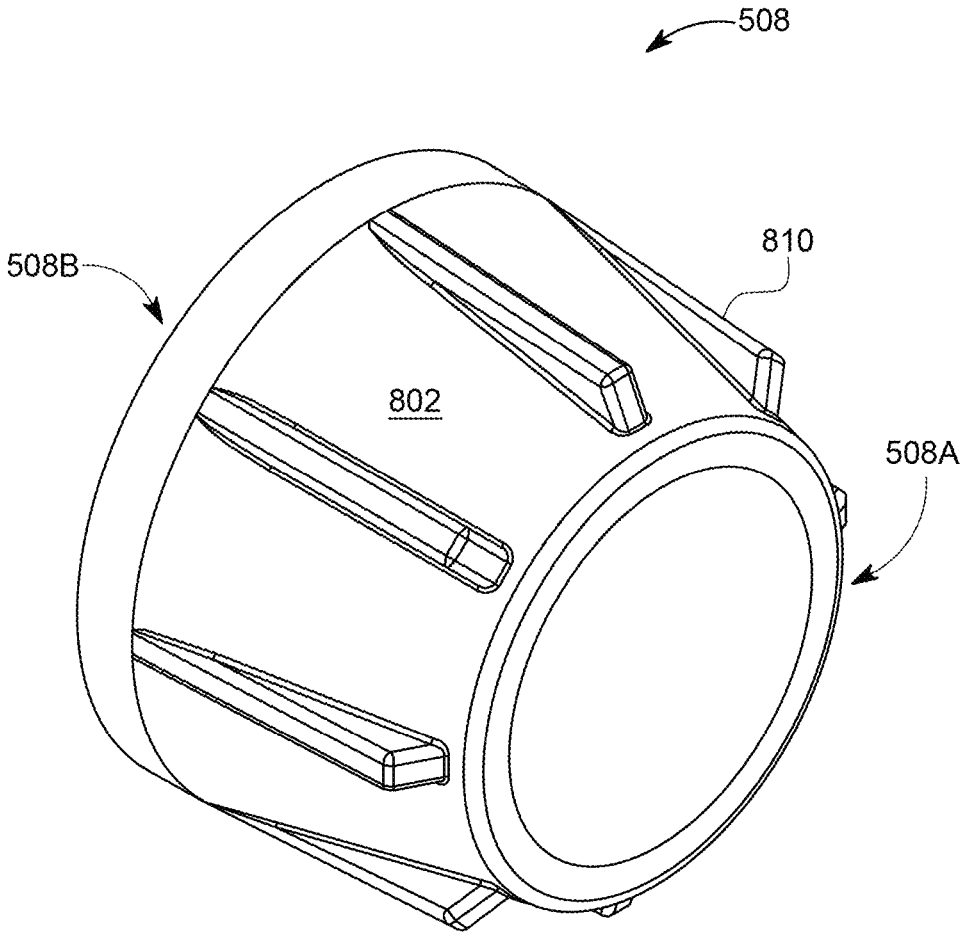
FIG. 8 shows a wedge having plural ridges that are configured to fit into the initiating trenches of the slip ring to lock the slip ring relative to the wedge.

The purpose of the trenches 712, which are called herein "separation trenches," is to enhance the separation of the segments 708-I when the plug 500 is set, while the purpose of the initiating trenches 706 is to initiate the separation of each segment 708-I from the adjacent segments and to promote the separation of all the segments from each other. To achieve this last goal, the upper wedge 508 is configured with plural ridges 810 that extend radially out from a body 802 of the wedge, as illustrated in FIG. 8. The body 802 is conical in this embodiment, to form a ramp on which the upper slip ring 506 is pushed by the push ring 504. As shown in FIG. 8, the ridge 810 has a higher height at the narrower end (upstream end) 508A than at the wider end (downstream end) 508B. In one application, the height of the ridge 810 becomes zero at the downstream end 508B. Each ridge 810 is aligned with a corresponding initiating trench 706. Thus, in one embodiment, there are as many ridges as the number of initiating trenches. In one application, both the ridges and the initiating trenches are uniformly distributed over their corresponding bodies.

Figure 9:
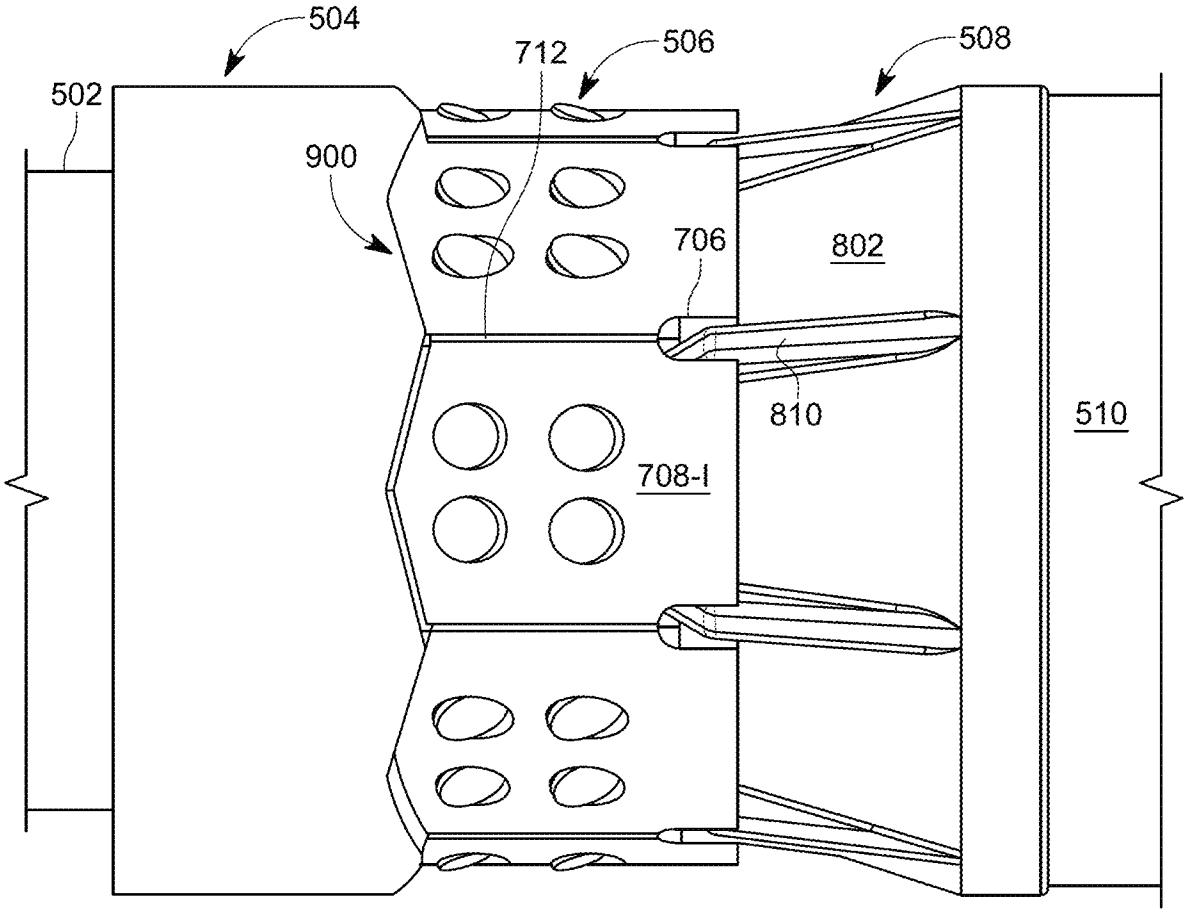
FIG. 9 shows in detail how the plural ridges lock into the initiating trenches.

When assembled, each ridge 810 partially enters into the corresponding initiating trench 706 as shown in FIG. 9. At the same time, the figure shows the wavy interface 900 between the push ring 504 and the upper slip ring 506. As previously discussed, the wavy interface 900 may be defined by planes of different orientations or by a smooth curved surface. The wavy interface 900 and the combination of ridge 810/initiating trench 706 ensure that the upper slip ring 506 is locked into place when the plug 500 is assembled and lowered into the well. This means that the upper slip ring 506 does not and cannot rotate relative to the mandrel 502.

The lower wedge 512 has the same structure as the upper wedge 508, i.e., it has a conical body 802 and plural ridges 810. Thus, in one application, the structure shown in FIG. 8 corresponds to both the upper and lower wedges 508 and 512. The sealing element 510 may be any of the known sealing elements, i.e., a sealing element that elastically deforms to press against the casing or a sealing element that plastically deforms to press against the casing. In one application, the sealing element is dissolvable. The sealing element may include at least one of an elastomer, a metal, and a non-metal material. The lower slip ring 514 may also have an identical structure as the upper slip ring 506, i.e., initiating trenches 706, splitting trenches 712, and slips 710.

Figure 10:
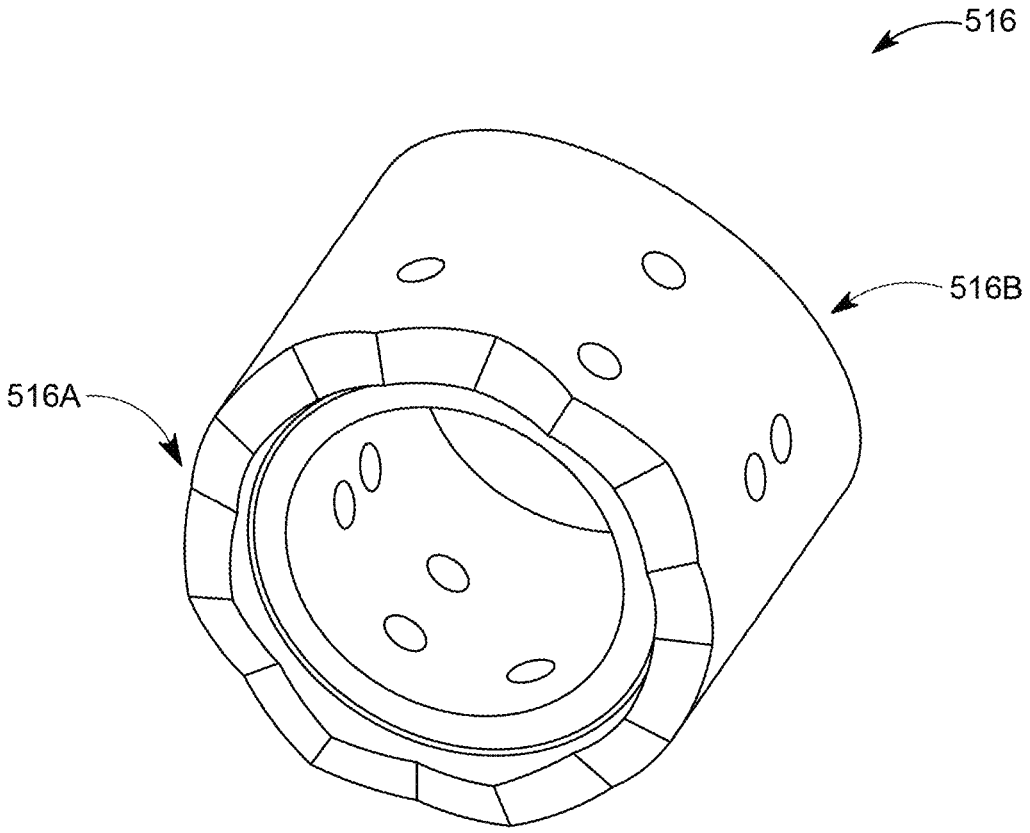
FIG. 10 shows a mule shoe that has a wavy end that is configured to engage and lock another slip ring of the plug.
Figure 11:
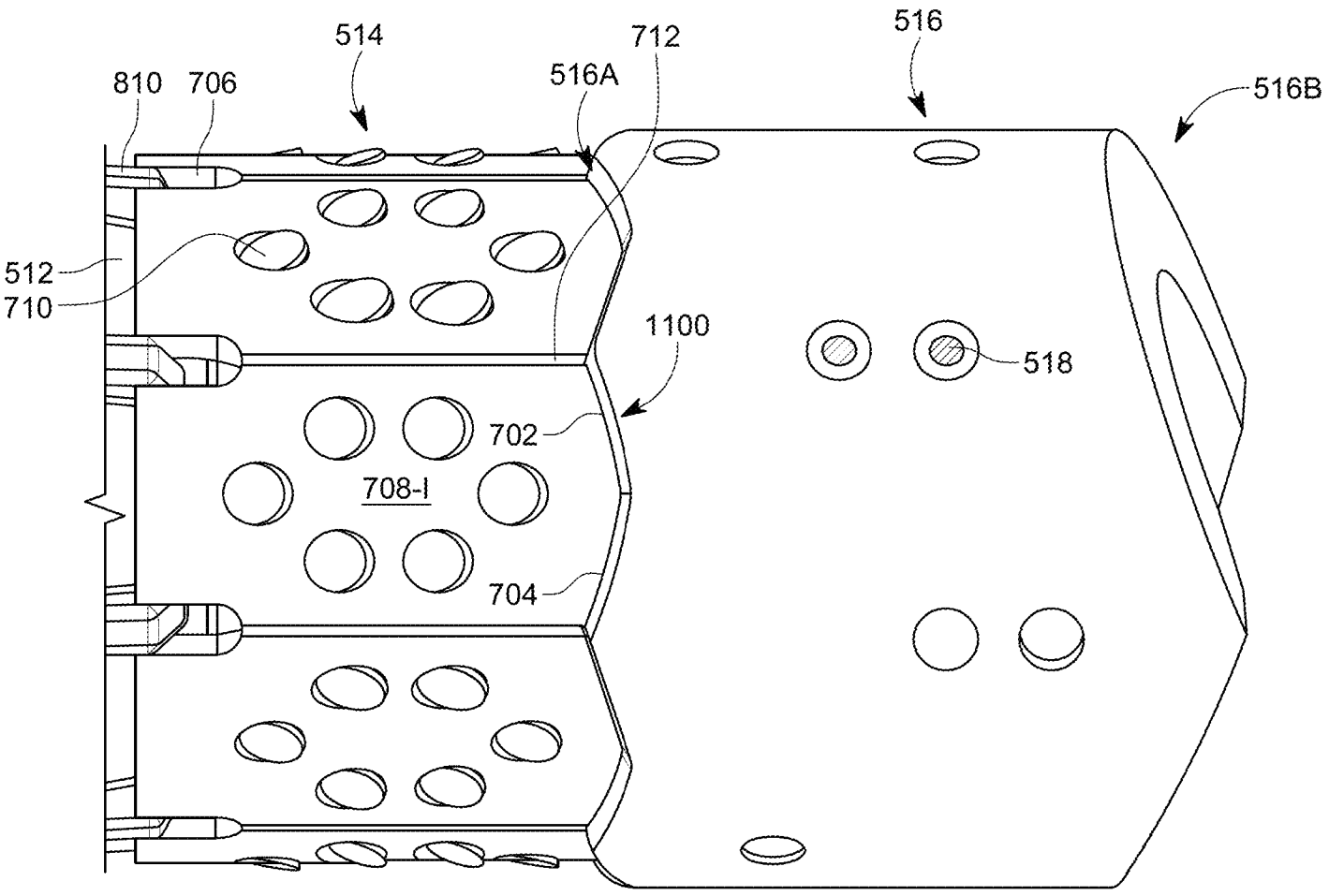
FIG. 11 shows in more detail the locking of the another slip ring with another wedges and with the mule shoe.

The mule shoe 516 is illustrated in FIG. 10 and has the upstream end 516A shaped to have a wavy configuration, that matches the wavy configuration of the downstream end of the lower wedge 512, as illustrated in FIGS. 5 and 11. Thus, an interface 1100 between the lower slip ring 514 and the mule shoe 516, as illustrated in FIG. 11, has a wavy shape, which is either defined by a plurality of planes having different orientations, or is defined by a smooth curved surface. Similar to the upper slip ring 506, because of the wavy interface 1100 and the combination of ridges 810 and initiating trenches 706 between the lower wedge 512 and the lower slip ring 514, the lower slip ring 514 is locked into place and cannot rotate relative to the mandrel of the plug 500. FIG. 11 further shows the non-planar shape of the downstream end 516B and the pins 518 that attach the mule shoe to the mandrel.

With this configuration, when the plug 500 is set by the corresponding setting tool, each segment 708-I of each of the upper and lower slip rings 506 and 514 are individually broken apart from each other, due to the plurality of ridges 810 formed on each of the wedges 508 and 512. Thus, when the plug is set, the traditional situation of failing to break apart each segment of the slip rings is avoided as the ridges 810 act as knives that cut apart each segment. This means that all the segments of the upper and lower slip rings are now separated and they are uniformly biased against the casing by the corresponding wedges 508 and 512, which ensures an even loading of the plug during a fracturing operation, and thus maximum load bearing. Because the slip rings are locked in place and they cannot rotate as the ridges 810 prevent this motion, this also allows for a positive lockup during the drilling out operation, i.e., after the plug has been deployed and the time has come to remove the plug.

While the wavy interfaces 900 and 1100 discussed herein were described above as being defined by either plural planar surfaces having different orientations or by a single smooth and curved surface, one skilled in the art would understand that other profiles may be used, for example, semi-circular key features, which limit stress but still allow a positive lock with the slip rings and mule shoe. In one application, the ridges 810 may be replaced with other elements that engage the initiating trenches 706 and also are able to separate each segment 708-I from the others, for example, pins attached to the conical body 802 of the wedges 508 and 512. One or more of the elements of the plug may be made of a composite material. In one application, most if not all the elements of the plug are made of the composite material. In one application, the ridges 810 are moldable, i.e., they are made of a composite material as the body 802 of the wedges.

The frac plug discussed above includes a mandrel 502. However, other plugs that may use the technology discussed herein may be configured to have no mandrel, see for example, a bridge plug or a wide plug. Thus, all the embodiments discussed above are also applicable to a plug with no mandrel. In addition, the embodiments discussed above show the wavy interfaces and the ridges on each side of the sealing element. However, the plug 500 can be used with only one wavy interface, either 900 or 1100, and only one set of ridges 810, only on the upper or lower wedges 508 and 512. In other words, the plug 500 can be used with only one wavy interface and only one set of ridges 810. The wavy interface and the set of ridges do not have to be on the same side (upstream or downstream) of the sealing element 510.

Figure 12:
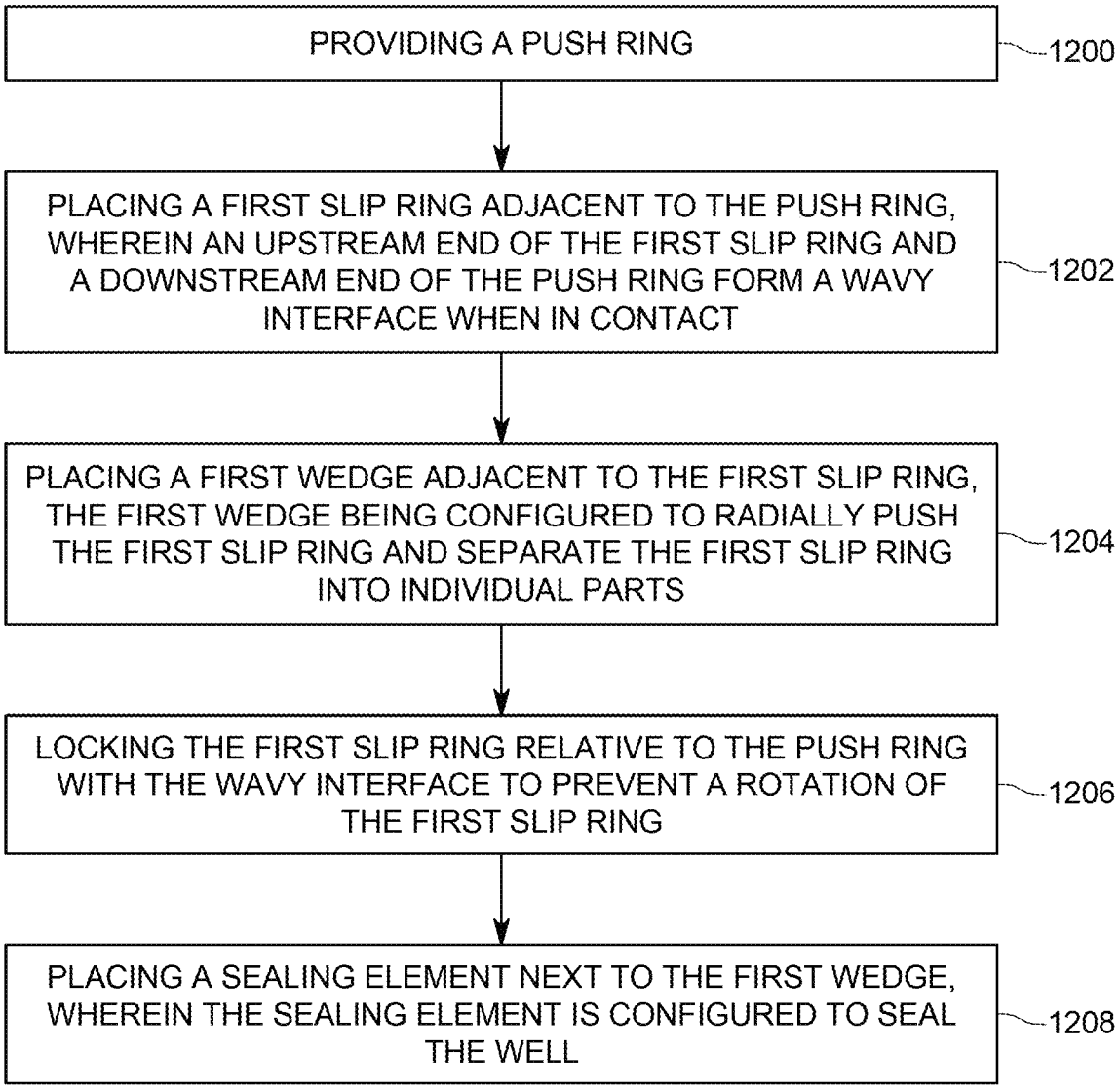
FIG. 12 is a flowchart of a method of assembling the novel plug shown in FIG. 5.

A method for assembling a downhole tool that has slip rings with uniform breaking parts is now discuss with regard to FIG. 12. The method includes a step 1200 of providing a push ring, a step 1202 of placing a first slip ring adjacent to the push ring, wherein an upstream end of the first slip ring and a downstream end of the push ring form a wavy interface when in contact, a step 1204 of placing a first wedge adjacent to the first slip ring, the first wedge being configured to radially push the first slip ring and separate the first slip ring into individual parts, a step 1206 of locking the first slip ring relative to the push ring with the wavy interface to prevent a rotation of the first slip ring, and a step 1208 of placing a sealing element next to the first wedge, wherein the sealing element is configured to seal the well. The method may further include a step of locking the first slip ring relative to the first wedge by engaging plural initiating trenches formed into a downstream end of the first slip ring with plural corresponding ridges extending radially out from a body of the first wedge.

The disclosed embodiments provide methods and systems for configuring a plug with an improved slip ring deployment. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A downhole tool for sealing a well, the downhole tool comprising:

a central longitudinal axis;

a push ring comprising a downstream end with a first profile that is non-flat relative to the central longitudinal axis;

a first slip ring located adjacent to the push ring and comprising an upstream end with a second profile that is non-flat relative to the central longitudinal axis and complementary to the first profile, such that engagement between the first profile and the second profile prevents relative rotation of the push ring and the first slip ring;

a first wedge located adjacent to the first slip ring and configured to radially push the first slip ring and separate the first slip ring into individual parts; and a sealing element located adjacent to the first wedge and configured to seal the well.

2. The downhole tool of claim 1, wherein the first slip ring has plural initiating trenches formed into a downstream end, and the first wedge has plural corresponding ridges extending radially out from a body of the first wedge.

3. The downhole tool of claim 2, wherein each of the plural initiating trenches is engaged with a corresponding ridge of the plural ridges so that the first slip ring cannot rotate relative to the first wedge.

4. The downhole plug of claim 3, wherein the first slip ring includes plural separation trenches that define the individual parts, and the plural separation trenches extend longitudinally along the first slip ring, from the initiation trenches.

5. The downhole plug of claim 4, wherein each separation trench of the plural separation trenches is aligned with a corresponding ridge of the plural ridges, and the plural ridges are configured to cut through the plural separation trenches to separate the parts from each other.

6. The downhole plug of claim 1, further comprising a second wedge located across the first wedge over the sealing element;

a second slip ring located adjacent to the second wedge and comprising a downstream end with a third profile that is non-flat relative to the central longitudinal axis; and a mule shoe located adjacent to the second slip ring and comprising an upstream end with a fourth profile that is non-flat relative to the central longitudinal axis and complementary to the third profile, such that engagement between the third profile and the fourth profile prevents relative rotation of the mule shoe and the second slip ring.

7. The downhole tool of claim 6, wherein the second slip ring has plural initiating trenches formed into an upstream end, and the second wedge has plural corresponding ridges extending radially out from a body of the second wedge.

8. The downhole tool of claim 7, wherein each of the plural initiating trenches of the second slip ring is engaged with a corresponding ridge of the plural ridges of the second wedge so that the second slip ring cannot rotate relative to the second wedge.

9. The downhole plug of claim 8, wherein the second slip ring includes plural separation trenches that define the additional individual parts, and the plural separation trenches extend longitudinally along the second slip ring.

10. The downhole plug of claim 9, wherein each separation trench of the plural separation trenches of the second slip ring is aligned with a corresponding ridge of the plural ridges of the second wedge, and the plural ridges are configured to cut through the plural separation trenches to separate the additional parts from each other.

11. The downhole tool of claim 1, wherein the first profile and the second profile are both defined by plural planes having various orientations relative to the central longitudinal axis.

12. A downhole tool for sealing a well, the downhole tool comprising:

a central longitudinal axis;

a sealing element located adjacent to the first wedge and configured to seal the well;

a push ring;

a first slip ring located adjacent to the ring and comprising plural initiating trenches formed into a downstream end;

a first wedge located adjacent to the first slip ring, configured to radially push the first slip ring and separate the first slip ring into individual parts, and comprising a smooth frustoconical body from which protrudes plural ridges;

wherein the initiating trenches and the ridges are configured to lock the slip ring in place relative to the first wedge.

13. The downhole plug of claim 12, wherein the first slip ring further comprises plural separation trenches that define the individual parts, and the plural separation trenches extend longitudinally along the first slip ring.

14. The downhole plug of claim 13, wherein each separation trench of the plural separation trenches is aligned with a corresponding ridge of the plural ridges, and the plural ridges are configured to cut through the plural separation trenches to separate the parts from each other.

15. The downhole tool of claim 12, wherein:

the push ring comprises a downstream end with a first profile that is non-flat relative to the longitudinal axis; and the first slip ring further comprises an upstream end with a second profile that is non-flat relative to the central longitudinal axis and complementary to the first profile, such that engagement between the first profile and the second profile prevents relative rotation of the push ring, and the first slip ring.

16. The downhole plug of claim 15, further comprising:

a second wedge located across the first wedge, over the sealing element;

a second slip ring located adjacent to the second wedge and comprising a downstream end with a third profile that is non-flat relative to the central longitudinal axis; and a mule shoe located adjacent to the second slip ring and comprising an upstream end with a fourth profile that is non-flat relative to the central longitudinal axis and complementary to the third profile, such that engagement between the third profile and the fourth profile prevents relative rotation of the mule shoe and the second slip ring.

17. The downhole tool of claim 16, wherein the second slip ring has plural initiating trenches formed into an upstream end, and the second wedge has plural corresponding ridges extending radially out from a body of the second wedge, and wherein each of the plural initiating trenches of the second slip ring is engaged with a corresponding ridge of the plural ridges of the second wedge so that the second slip ring cannot rotate relative to the second wedge.

18. A method for assembling a downhole tool that has slip rings with uniform breaking parts, the method comprising:

providing a push ring comprising a downstream end with a first profile that is non-flat relative to a central longitudinal axis of the downhole tool;

providing a first slip ring comprising an upstream end with a second profile that is non-flat relative to the central longitudinal axis of the downhole tool and complementary to the first profile;

placing the first slip ring adjacent to the push ring, such that engagement of the first profile and the second profile prevents relative rotation of the push ring and the first slip ring;

placing a first wedge adjacent to the first slip ring, the first wedge being configured to radially push the first slip ring and separate the first slip ring into individual parts; and placing a sealing element next to the first wedge, wherein the sealing element is configured to seal the well.

19. The method of claim 18, further comprising:

locking the first slip ring relative to the first wedge by engaging plural initiating trenches formed into a downstream end of the first slip ring with plural corresponding ridges extending radially out from a body of the first wedge.

* * * * *